US005771833A

United States Patent [19]

Hasse

[11] Patent Number: 5,771,833

[45] Date of Patent: Jun. 30, 1998

[54] ARRANGEMENT FOR SWEEPING MOORED LINES

[75] Inventor: Werner Hasse, Hamburg, Germany

[73] Assignee: Rheinmetall Industrie Aktiengesellschaft, Ratigen, Germany

[21] Appl. No.: 749,116

[22] Filed: Nov. 14, 1996

[30] Foreign Application Priority Data

Nov. 14, 1995 [DE] Germany ..... 195 42 377.1

[51] Int. Cl.[6] ..... B62D 1/26

[52] U.S. Cl. ..... 114/221 A; 89/1.13

[58] Field of Search ..... 114/242–245, 221 A, 114/221 R; 89/1.13, 1.14

[56] References Cited

U.S. PATENT DOCUMENTS

| | | | |
|---|---|---|---|
| 3,844,244 | 10/1974 | White | 114/221 |
| 3,850,075 | 11/1974 | Temple | 89/1 B |
| 4,112,862 | 9/1978 | Huly et al. | 114/221 |
| 4,606,293 | 8/1986 | Kirkland | 114/221 A |
| 4,696,234 | 9/1987 | Kaltmann et al. | 102/308 |
| 4,805,547 | 2/1989 | Matsuzaki et al. | 114/221 A |
| 5,042,387 | 8/1991 | Backstein | 102/402 |
| 5,386,793 | 2/1995 | Gaudiano et al. | 114/253 |

FOREIGN PATENT DOCUMENTS 3921491 1/1991 Germany .

*Primary Examiner*—Ed L. Swinehart
*Attorney, Agent, or Firm*—Spencer & Frank

[57] ABSTRACT

An arrangement for sweeping moored mines (8) with at least one cable cutter (4) that is arranged on a sweeping line (2) and is designed for cutting through the mooring line (9) for a respective mine (8). To achieve a relatively fast and safe destruction of the moored mines (8), in addition to the cable cutters (4), mine destruction devices (3) are also attached to the respective sweeping line (2), which devices are fastened respectively in front of the snap grippers (4) in towing direction. The mine destruction devices (3) each have on clamping device (12) that can attach itself to the mooring line (9), a buoyancy element (14) that is connected to the clamping device (12) with an unreelable line (16) and a mine destroying activator (15) that is attached to the buoyancy element (14). If the mooring line (9) hits the mine destruction device (3), the clamping device (12) detaches itself from the sweeping line and clamps down on the mooring line (9). The activator (15) then detaches itself from the clamping device (12) and rises with the aid of the buoyancy element (14) toward the mine (8). The mooring line (9) at the same time advances along the sweeping line (2) into the gripper mouth of the following cable cutter (4) and is cut by it at a position below the attached clamping device.

3 Claims, 3 Drawing Sheets

ARRANGEMENT FOR SWEEPING MOORED LINES

REFERENCE TO RELATED APPLICATIONS

This application claims the priority of German application Ser. No. 19542377.1, filed Nov. 14, 1995, which is incorporated herein by reference.

BACKGROUND OF THE INVENTION

The invention relates to an arrangement for sweeping moored mines with at least one cable cutter which is arranged on a towed sweeping line and which is designed for cutting the mooring line or cable for a respective moored mine.

The sweeping of moored mines with the aid of cable cutters is known, for example, from German laid-open Patent Application No. DE-OS 25 48 595. For this, a mechanical sweeping gear, which consists of a sweeping line, a height finder or depth finder, an otter board and the cable cutter, is dragged or towed behind a mine sweeper. The cable cutter glides horizontally through the water, so that the cable cutter mouth can grip a vertically extending mooring line (consisting of a cable or a chain, etc). If the sweeping line hits a mooring line, it moves along it until the mooring line is gripped by the cable cutter mouth. The cable cutter cuts the mooring line and thus forces the moored mine to float toward the surface, where it can subsequently be neutralized.

Such arrangements have the disadvantage that the sweeping of a predetermined area is very time-consuming. Also, the mines drifting on the surface frequently are not visible in rough waters.

It is the object of the invention at hand to provide an arrangement of the aforementioned type which permits a relatively fast and safe removal or destruction of the moored mines.

SUMMARY OF THE INVENTION

The above mentioned is achieved according to the present invention by an arrangement for the sweeping of moored mines comprising: at least one cable cutter, for cutting a mooring line for a respective moored mine, which is arranged on a sweeping line; and a respective mine destruction device attached to the sweeping line and in front of a respective cable cutter in a towing direction, with the mine destruction device including a clamping device that is attachable to a mooring line of a respective mine, a buoyancy element connected to the clamping device via an unreelable line, an activator for destroying a mine and which is attached to the buoyancy element, and means for releasably attaching the clamp device, the activator and the buoyancy element to the sweeping line such that after a mooring line runs into a respective mine destruction device, the clamping device detaches itself from the sweeping line and clamps onto the mooring line and the buoyancy element with attached activator subsequently is released and moved toward the mine attached to the respective cable; and wherein the clamping device is arranged on the mine destruction device such that the following cable cutter, which hits the respective mooring line after the clamping device of the associated mine destruction device clamps down on the mooring line, cuts through the mooring line at a position below the attached clamping device. Further advantageous embodiments and modifications of the invention are disclosed.

The invention is essentially based on the idea that in addition to the cable cutters, which are known per se, mine destruction devices are arranged on the respective mine sweeping line, and are respectively arranged in front of the respective cable cutters in the dragging direction. The mine destruction devices each have a clamping device that can be clamped onto the mooring cable, a buoyancy element that is connected to the clamping device with an unreelable cable or line, and an activating element or activator that is attached to the buoyancy element and used to destroy a mine.

If the mooring line runs into the mine destruction arrangement, then the clamping device detaches itself from the sweeping line and clamps onto the mooring line. The activator, in turn, detaches itself from the clamping device and rises with the aid of the buoyancy element toward the mine. At the same time, the mooring cable advances further along the sweeping line into the mouth of the following cable cutter and is cut off by the cable cutter at a height below the clamping device. This ensures that a following mooring line can run without obstacle into the next arrangement, consisting of a mine destruction arrangement and a cable cutter.

The buoyancy element is connected to a gas producer, which is preferably activated by movement of the clamping device, via an engaging lever. The gas producer can be a compressed air source, a $CO_2$generator or a pyrotechnical compressed gas producer.

It has proven advantageous if the buoyancy element is provided with a pressure compensation valve, so that the pressure difference between the inside pressure of the buoyancy element in its inflated condition and the respective pressure of the water surrounding the buoyancy element is independent of the depth at which the buoyancy element is respectively located. A pressure difference of 0.5 bar has proven advantageous in practical operations.

For one particularly advantageous embodiment of the invention, the buoyancy element in the inflated condition has a helical shape that extends in the direction of the mooring line, so that the buoyancy element carries the activation system along a spiral path around the mooring line to the mine vessel. On the one hand, this prevents a drifting-apart of the mine and activator. On the other hand, possible obstacles on the mooring line such as tear-off grippers or other devices, designed to protect against mine sweeping, are circumvented.

BRIEF DESCRIPTION OF THE DRAWINGS

Further details and advantages of the invention result from the exemplary embodiments that are explained in the following with the aid of figures wherein.

DETAILED DESCRIPTION OF THE PREFERRED EMBODIMENT

Figure 1:
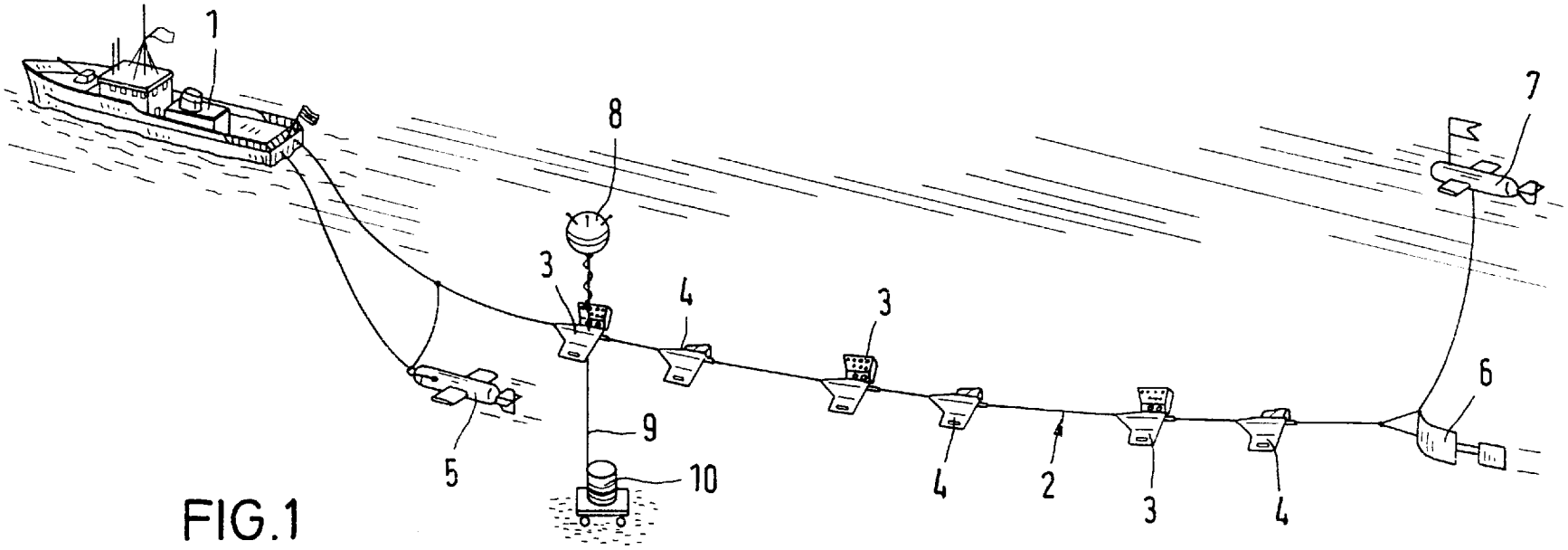
FIG. 1 is a diagrammatic view of a minesweeper with a sweeping arrangement according to the invention, and consisting of cable cutters and mine destruction devices on a sweeping line.

In FIG. 1, a minesweeper with reference number 1 is towing a sweeping line 2. This line 2 consists of line segments, which are connected via the mine destruction devices 3 and the cable cutters 4 with each mine destruction devices 3 being followed by a respective cable cutter 4. The desired sweeping depth and sweeping width is achieved with the aid of depth finders 5, otter boards 6 as well as marker buoys 7. The reference number 8 belongs to a moored mine, which is fastened via a respective mooring line 9 to a mooring sinker or support 10.

Figure 2:
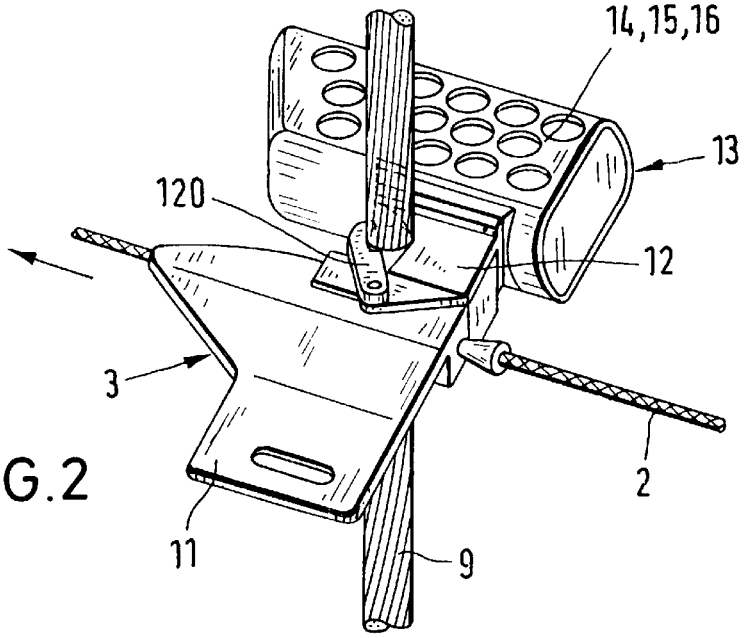
FIG. 2 is a perspective view of a mine destruction device according to the invention while the clamping device with associated buoyancy element and activator is clamping down on the mooring line.
Figure 4:
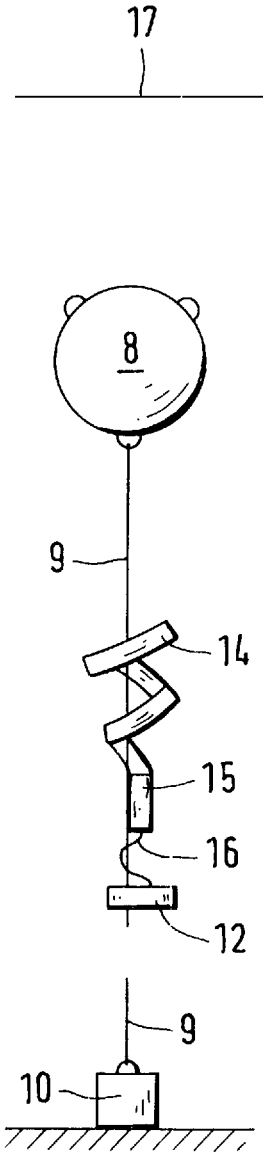
FIG. 4 and FIG. 5 illustrate the position of the buoyancy element and activator moving upwards along the mooring line, seen at two different points in time.

FIG. 2 shows a mine destruction device 3, which has already made contact with the mooring line 9. The mine destruction device has a stabilizer fin 11, to which a clamping device 12 with casing 13 is attached such that it can detach itself from the stabilizing fin 11. Inside of casing 13 is a folded-up buoyancy element 14 (see FIG. 4) with a gas producer, an activator 15, which is connected to the buoyancy element 14, for destroying the mine 8, and an unreelable line 16, which connects the buoyancy element 14 with the clamping device 12.

When the mooring line 9 runs into the clamping device 12, a clamp 120, which is prestressed with a spring, clamps tightly around the mooring line 9, so that the clamping device 12 as well as casing 13 with activator 15 are connected securely to the mooring line 9 for mine 8. The clamping device 12 is at the same time separated from the stabilizer fin 11.

The folded-up buoyancy element 14 is subsequently inflated with the aid of the non-depicted gas producer and is pushed over the mooring line 9 for mine 8 in such a way that it winds around the mooring line 9 (FIGS. 4 and 5) in the shape of a conically downward tapered helix. The activation of the gas producer takes place directly via an engaging lever for the clamping device, which is not shown here for reasons of clarity.

Figure 3:
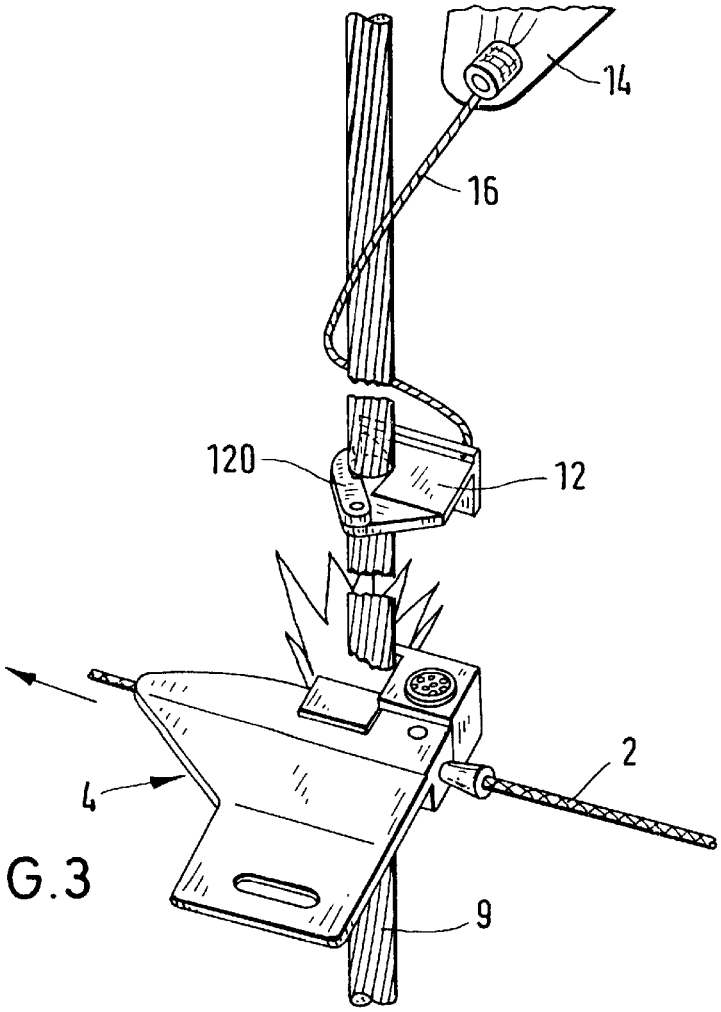
FIG. 3 is a perspective view of a cable cutter in the process of cutting through a mooring line.
Figure 5:
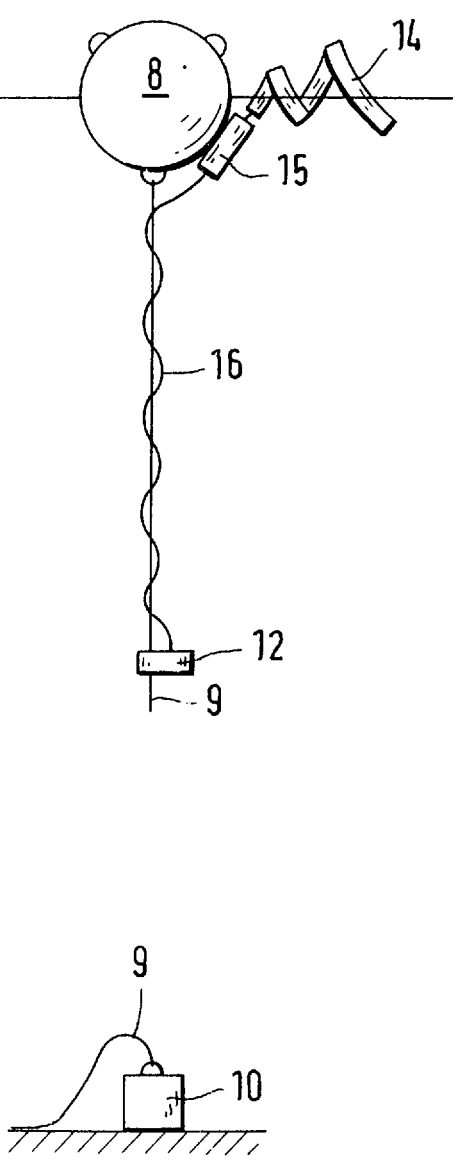

After the buoyancy element 14 and the activator 15, which remains inside the casing 13, have moved away from the clamping device 12, the mooring line 9 runs into the opening for the cable cutter 4 (see FIG. 3), which is known per se. This cutter 4 cuts the mooring line 9 at a location below the attached clamping device 3, so that during the upward movement of the activator 15, the mine 8 also rises to the water surface 17 as shown in FIG. 5. After swimming or floating to the top, the mine 8 and the activator 15, which is connected to the mine with line 16, are tightly pulled together by a line tensioning device that is not shown and the charge of the activator 15 is ignited in a known manner, so that the mine 8 is destroyed.

The invention now being fully described, it will be apparent to one of ordinary skill in the art that any changes and modifications can be made thereto without departing from the spirit or scope of the invention as set forth herein.

What is claimed:

1. Arrangement for the sweeping of the moored mines comprising:

at least one cable cutter, for cutting a mooring line for a respective moored mine, which is arranged on a sweeping line; and a respective mine destruction device attached to the sweeping line and in front of a respective said cable cutter in a towing direction, said mine destruction device including a clamping device that is attachable to a mooring line of a respective mine, a buoyancy element connected to the clamping device via an unreelable line, an activator for destroying a mine and which is attached to said buoyancy element, and means for releasably attaching the clamping device activator and buoyancy element to said sweeping line such that after a mooring line runs into a respective mine destruction device, the clamping device detaches itself from the sweeping line and clamps onto the mooring line and the buoyancy element with attached activator subsequently is released and moves upward toward the mine attached to the respective cable; and wherein the clamping device is arranged on the mine destruction device such that a respective one of said cable cutters which is following a respective said destruction unit and which hits the respective mooring line after the clamping device of the associated respective said mine destruction device clamps down on the mooring line, cuts through the mooring line at a position below the attached clamping device.

2. Arrangement according to claim 1, wherein the buoyancy element,in an inflated condition, has a helical shape that extends in the direction of the mooring line, so that the buoyancy element and the activator float upwards on a spiraling path around the mooring line and toward the mine.

3. Arrangement according to claim 2, wherein the buoyancy element, in an inflated condition, has a shape that is tapered conically downward.

* * * * *